United States Patent [19]

Nitzberg et al.

[11] Patent Number: 4,658,679

[45] Date of Patent: Apr. 21, 1987

[54] NAIL-HOLDING ACCESSORY FOR HAMMERS

[76] Inventors: Jerold I. Nitzberg; Magdalena Nitzberg, both of 3029 Fleetwood Ave., Baltimore, Md. 21214

[21] Appl. No.: 795,929

[22] Filed: Nov. 7, 1985

Related U.S. Application Data

[63] Continuation-in-part of Ser. No. 731,009, May 6, 1985, abandoned.

[51] Int. Cl.[4] ..... B25D 1/04

[52] U.S. Cl. ..... 81/23; 81/452

[58] Field of Search ..... 81/23, 24, 451, 452, 81/125

[56] References Cited

U.S. PATENT DOCUMENTS

| | | | |
|---|---|---|---|
| 299,717 | 6/1884 | Barber | 81/23 |
| 450,011 | 4/1891 | Hackett | 81/23 |
| 976,679 | 11/1910 | Morrison | 81/23 |
| 1,410,801 | 3/1922 | Erickson | 81/23 |
| 1,928,268 | 9/1933 | Sanders | 81/23 |
| 4,270,587 | 6/1981 | Ludy | 81/23 |

*Primary Examiner*—Frederick R. Schmidt
*Assistant Examiner*—Bradley I. Vaught
*Attorney, Agent, or Firm*—Brian Davidson

[57] ABSTRACT

A nail holding accessory for a hammer includes a body member having an upstanding pair of gripping fingers formed at a forward end thereof and an arcuate surface defined at a rearward end thereof. The pair of gripping fingers establish therebetween an open-ended slot for receiving and retaining a nail forwardly of a striking face of the hammer. An elastomeric band having a portion connected to the body member forwardly of the arcuate surface and a remaining portion adapted to encompass a transverse exterior section of the hammer rearwardly of the striking face thereof is provided for coupling the body member to the hammer such that the pair of gripping fingers are positioned forwardly of the striking face of the hammer. Rebound of the hammer away from a nail initially driven into a wooden board or like workpiece causes the gripping fingers to exert a pivot force on the body member thereby responsively pivoting the gripping fingers away from the striking face of the hammer to release the nail. The bias force provided by the elastomeric band thus urges the arcuate surface to bear against the hammer head so as to assist in retaining the body member in its inoperative position thereby providing an unobstructed hammer striking face.

11 Claims, 7 Drawing Figures

NAIL-HOLDING ACCESSORY FOR HAMMERS

CROSS-REFERENCE TO RELATED APPLICATION

This application is a continuation-in-part of U.S. application Ser. No. 731,009 filed May 6, 1985 in the name of Jerold I. Nitzberg and Magdalena Nitzberg and entitled. "A Nail Holder Attachment for Hammers", now abandoned, (the entire disclosure thereof being expressly incorporated herein to by reference).

FIELD OF THE INVENTION

The present invention generally relates to accessories for hammers which retain a nail forwardly of the hammer's striking face so as to assist in the hammering of the nail into a workpiece. More particularly, the present invention relates to an accessory which not only retains a nail forwardly of a hammer's striking surface, but which is also capable of releasing the nail automatically once the nail has been initially driven into the work piece. Thus, the accessory of this invention is capable of automatically pivoting into an inoperative position thereby providing unobstructed access to the hammer's striking face so that the full length of the nail's shaft can then be driven into the workpiece without interruption.

BACKGROUND OF THE INVENTION AND INFORMATION DISCLOSURE STATEMENT

Devices which have as their principal purpose the holding of nails, tacks and like securing elements against a hammer head to thereby assist in the driving of the nails, tacks and the like into a work piece are, in and of themselves, well know as evidenced by the following publications:

U.S. Pat. No. 469,710 to Munn, et al.
U.S. Pat. No. 3,169,255 to Simmons
U.S. Pat. No. 4,367,778 to Bradbury
U.S. Pat. No. 510,049 to Ryan
U.S. Pat. No. 4,270,587 to Ludy
U.S. Pat. No. 903,095 to Johnson
U S. Pat. No. 698,631 to Carlisle
U.S. Pat. No. 640,169 to Barger
Canadian Pat. No. 480,620 to Zatrepalek.

Munn, et al. disclose a nail holder hooked into loops formed in the sides of a strap and a V-shaped portion for receiving a tack. In use, the V-shaped portion is first manually swung upwardly away from the hammer's striking surface to as to permit a tack to be inserted therein and is then mutually swung in over the hammer's striking surface so as to be in position to be driven into a board or the like.

Simmons '255 discloses a hammer and punch assembly whereby the punch is pivotally mounted to the hammer head and includes a spring-biased plunger to releasably hold the punch in either a position wherein the punch member itself extends forwardly of the hammer's striking surface or a position wherein the punch is housed in a reentrant portion defined in the hammer head.

Bradbury '788 discloses a circular body portion having a central receptacle for insertably receiving the driving or impact head of the hammer and a yoke portion for supporting a nail shank forwardly of the hammer's striking surface.

Ryan '049 discloses a double-headed hammer having prongs which grip a nail or tack.

Ludy discloses a pair of juxtaposed, generally coextensive cantilever members of spring material having overlapping free ends located adjacent to the hammer head so as to clamp the head of a nail therebetween.

Johnson '095 discloses a tube section for encompassing the neck of a hammer and which defines a dependent channel aligned substantially parallel to the shank of the hammer head for releasably retaining a nail therein.

Carlisle '631 discloses a clip having a back-turned end portion and diverging spring-prongs for retaining a nail on the side of a hammer head.

Barger '169 discloses a nail-holding device having a piece of wire which is bent and formed into a V-shaped portion so as to receive the head of a nail and the means for mounting the V-shaped portion on a side of a hammer head.

Zatrepalek '620 discloses a device adapted to hold a nail parallel to the shank of the hammer head and includes an adjustable nail striking head separate from the striking face of the hammer.

As the reader will appreciate from even a cursory review of the above prior art proposals for nail holding accessories, some improvements have been needed so as to enable relatively unencumbered use of the hammer once the nail has been started into a wooden board or other similar work piece. According to the present invention, the nail holding accessory for a hammer permits the nail to be carried forwardly of the hammer head striking surface so that the user can initially drive a portion of the nail into the work piece, but yet includes the means which releases the nail when the hammer is reactively moved away from the nail head.

To achieve such functions, the present invention includes an elongate body member having an integral upstanding pair of gripping fingers formed at a forward end thereof and a bearing surface defined at a rearward end thereof. The pair of gripping fingers establish therebetween an open-ended slot so as to receive and retain a nail forwardly of the striking surface of the hammer. An elastomeric band having a portion connected to the body member forwardly of the bearing surface and a remaining portion adapted to encompass a transverse exterior section of the hammer rearwardly of the hammer's striking surface couples the body member to the hammer such that the pair of gripping fingers are operatively positioned forwardly of the hammer's striking surface. The elastomeric band (by virtue of its connection to the elongate body forwardly of the bearing surface) advantageously biases the gripping fingers into their operative position forwardly of the hammer's striking surface while yet also biasing the elongate body member into an inoperative position removed from the striking surface when the elongate body is responsively and automatically pivoted about the bearing surface during rebound of the hammer away from the nail.

Further aspects and advantages of the present invention will become more clear to the reader after careful consideration is given to the detailed description of the preferred exemplary embodiment thereof which follows.

BRIEF DESCRIPTION OF THE ACCOMPANYING DRAWINGS

Reference will hereinafter be made to the accompanying drawings wherein like reference numerals throughout the various figures denote like structural and wherein.

DETAILED DESCRIPTION OF THE PREFERRED EXEMPLARY EMBODIMENTS

Figure 1:
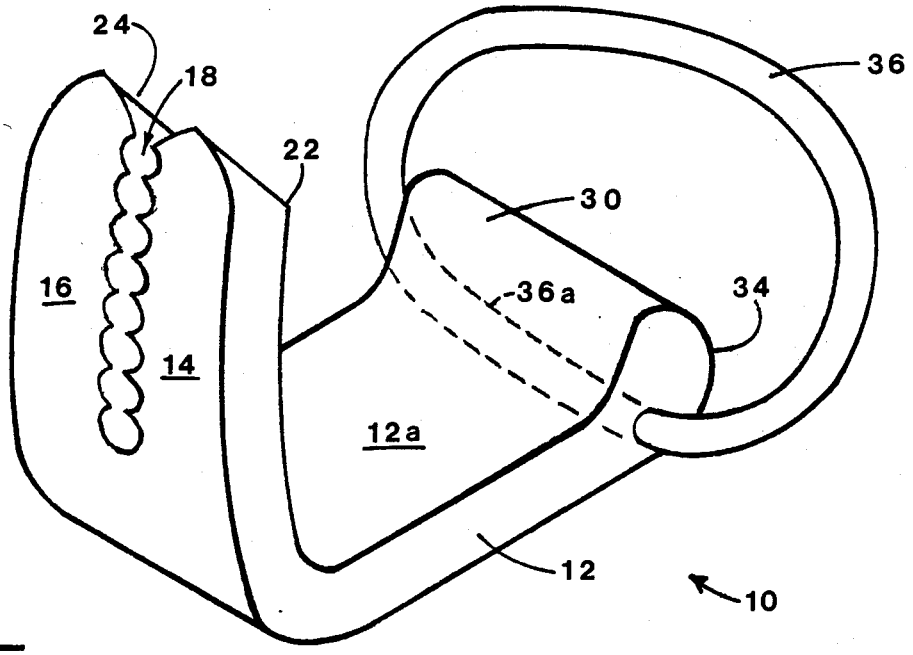
FIG. 1 is a perspective view of the nail holding accessory of the present invention.
Figure 2:
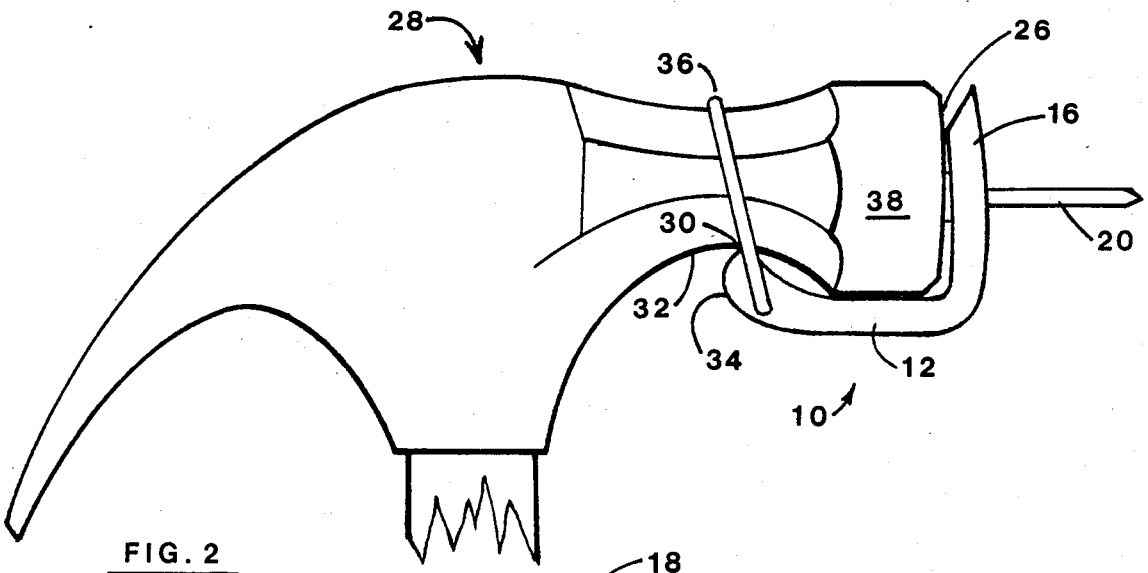
FIG. 2 is a side view of the nail holding accessory shown in its operative position on a hammer head with the nail retained forwardly of the hammer's striking surface.
Figure 3:
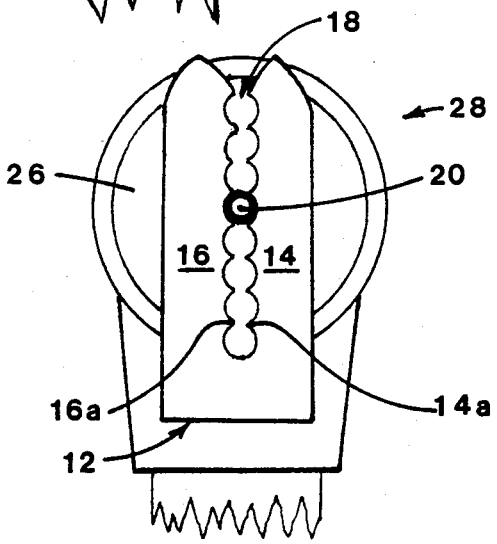
FIG. 3 is a front view of the nail holding accessory and hammer head taken along lines 3—3 in FIG. 2.

As can be seen in FIG. 1, the nail holding accessory 10 of the present invention generally includes a unitary body member 12 having at a forward end thereof a pair of upstanding gripping fingers 14, 16, respectively. The pair of gripping fingers 14, 16 define therebetween an open-ended slot 18 for accepting and retaining a nail 20 therein (see FIGS. 2 and 3). The pair of gripping fingers 14, 16 extend substantially perpendicular relative to body member 12 and are also preferably rearwardly canted so that terminal end portions 22, 24, respectively, are adapted to engage the striking surface 26 of hammer head 28 as can be seen more clearly by reference to FIG. 2. The accessory 10 also defines at a rearward end thereof a substantially planar bearing surface 30 adapted to bear against the neck 32 of hammer head 28 when the accessory 10 is in its operative position (i.e. in a position whereby a nail is held forwardly of the striking face 26 of hammer 28 as shown in FIG. 2). The rearward end of body member 12 also defines an arcuate surface 34 joined to a rear edge of surface 30, the purpose and function of which will be described in greater detail below.

An elastomeric band 36 is preferably molded into body member 12 so that body member 12 and band 36 are capable of pivotal slippage therebetween. Thus, band 36 is preferably an elastomeric "0-ring" having a portion 36*a* molded within body member 12. The remaining portion of band 36 not molded within body member 12 (i.e. that portion shown in solid line in FIG. 1) is thus adapted to encompass the neck portion 32 of hammer 28 so as to bias the upper surface 12*a* elongate body member 12 into engagement with the bell portion 38 of hammer 28 when the accessory 10 is in its operative position. At this time, surface 30 also bears against the neck 32 of hammer 28.

Fingers 14, 16 are preferably integrally formed with body member 12 but could also be separate replaceable structures fixed to body member 12 in any suitable manner. It is thus presently preferred that body member 12 and fingers 14, 16 be entirely formed of a suitable shape-retaining resilient material (e.g. polyurethane) molded into a unitary structure according to techniques well known to those in the molding arts. It is also preferred that slippage between band 36 and body 12 be provided so as to ensure that undue torsional stresses will not be experienced by band 36 when body member 12 pivots between its operative and inoperative positions (to be described later). To accomplish such purpose, portion 36*a* can be coated with a well known mold release agent, such as petroleum jelly, silicone and the like prior to molding of band 36 within body member 12. Thus, the release agent will prevent bonding of band 36 (and particularly portion 36*a*) to body member 12 during manufacture so as to ensure relative slippage therebetween.

Figure 4:
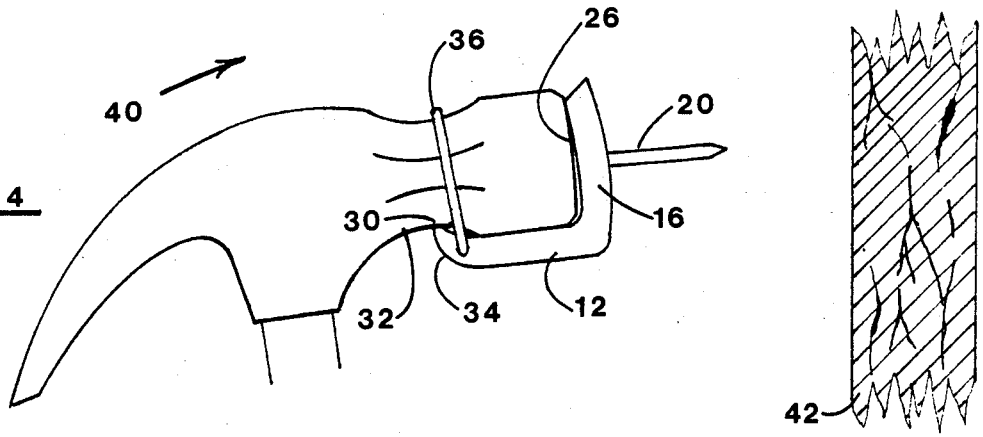
FIGS. 4 through 7 are sequential views showing the nail holding accessory in use.
Figure 5:
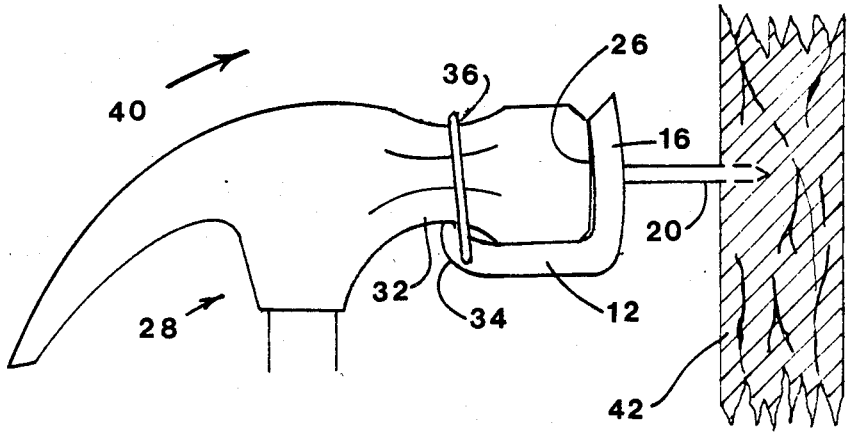

Referring to FIGS. 4–7 it is seen that in use, the accessory 10 is coupled to hammer 28 by means of elastomeric band 36 such that the upstanding gripping finger 14, 16 are positioned forwardly of the striking face 26. In such a position, the planer surface 30 will bear against the neck portion 32 of hammer 28 while surface 12*a* bears against bell portion 38. A nail 20 is then manually inserted into slot 18 and is retained therein by virtue of the serrated opposing edges 14*a*, 16*a* formed respectively on gripping fingers 14, 16 (see FIG. 3). The hammer 28 with the nail 20 being retained forwardly of the striking face 26 is then moved in the direction of arrow 40 toward a wooden board or other like work piece 42. When the nail 20 strikes board 42, a portion of its shank will be driven into board 42 as can be seen in FIG. 5. A natural rebound of the hammer 28 will thus occur and will possibly be aided by the natural withdrawal of the hammer 28 away from the nail 20 by the user.

Figure 6:
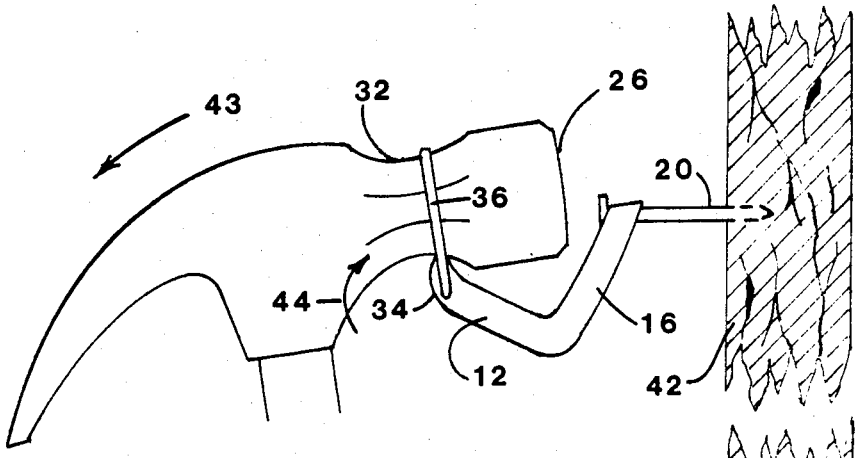
Figure 7:
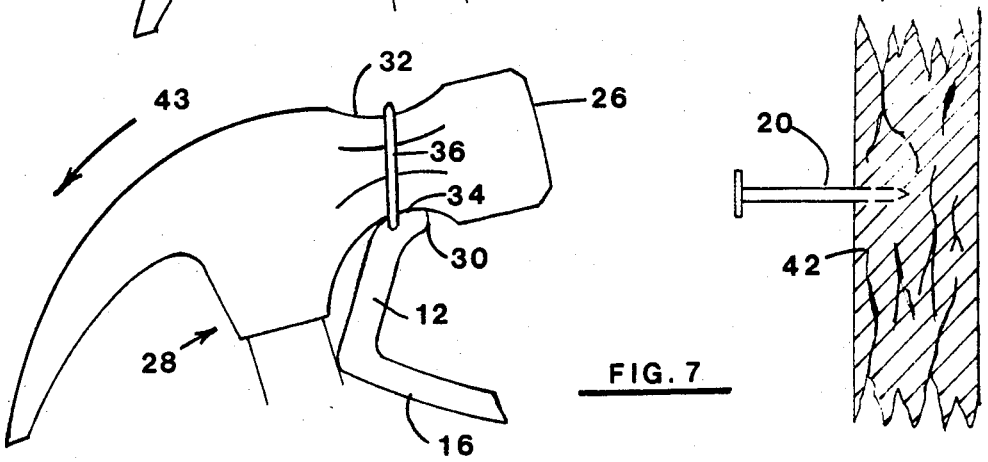

When rebounding of the hammer 28 occurs (arrow 43), the gripping fingers 14, 16 will be flexed outwardly away from the striking face 26 of hammer 28 due to the nature of the elastomeric material forming the fingers 14, 16 as can be seen in FIG. 6. This outward resilient displacement of fingers 14, 16, in turn, forces the rear end of member 12 to be pivoted in the direction of arrow 44 against the neck 32 of the hammer 28 such that the bearing relationship between the hammer 28 and the rear end of body member 12 is transferred from planar surface 30 to arcuate surface 32. When the arcuate surface 34 of elongate member 12 bears against the neck 32 of hammer 28, the planar surface 30 of member 12 has pivoted through a plane established by the elastomeric band 36 and its connection points to the body 12. Hence, the biasing force of the elastomeric band will urge the member 12 in a direction tending to assist in its pivotal movement in the direction of arrow 44 towards its inoperative position as shown in FIG. 7.

It should be particularly noted that when the body member 12 is in its operative position (i.e. as shown in FIG. 4) the bias force provided by means of elastic band 36 tends to pivot the member 12 in a direction opposite to that of arrow 44—that is, so as to assist in retaining the gripping fingers 14, 16 forwardly of the striking face 26 of hammer 28. This advantageous "counterbalancing" reliably maintains nail 20 in position for being driven into board 42 while yet permitting for the elongate member 12 to be pivoted towards its inoperative position automatically when the hammer 28 is reactively moved away from the nail 20. Moreover, the bias force provided by means of band 36 assists in maintaining the body member 12 in its inoperative position when the bias force of band 36 is exerted in the direction of arrow 44. As can be appreciated therefore, the inoperative position of the accessory 10 of the present invention thus provides unobstructed access to striking surface 26 so that the user can continue to drive nail 20 into board 42 without interruption.

While the present invention has been described in what is presently conceived to be the most preferred and exemplary embodiment thereof, those in the art may recognize that many modifications may be made, which modification shall be accorded the broadest scope of the appended claims so as to encompass all equivalent structures and assemblies.

What is claimed:

1. An accessory for a hammer head to retain a nail adjacently opposite to a striking surface of the hammer head thereby permitting said nail to be initially driven into a work piece and to release said nail once said nail has been initially driven into and thus captured by said work piece, said accessory comprising:

an accessory body having proximal and distal ends and including (a) gripping means formed at said distal end for resiliently and releasably gripping a nail, and (b) a bearing surface defined at said proximal end for bearing against said hammer head and for establishing means permitting pivotal articulation between said accessory body and said hammer head to thereby allow said accessory body to be pivoted between an operative position wherein said gripping means is positioned forwardly of said hammer head striking surface and an inoperative position wherein said gripping means is displaced rearwardly of said hammer head striking surface; and coupling means adapted for coupling said accessory body to said hammer head, said coupling means of providing a biasing force upon said accessory body in a first pivot direction which assists in retaining said accessory body in said operative position, and for exerting a biasing force upon said accessory body in a second pivot direction, opposite to said first pivot direction, which assists in retaining said accessory body in said inoperative position, said coupling means exerting said bias force in second pivot direction in response to said bearing surface bearing against said hammer head during pivotal movement of said accessory body from said operative position and into said inoperative position.

2. An accessory as in claim 1 wherein said bearing surface defining means defines a first substantially planar surface which bears against said hammer head when said accessory body is in said operative position, and a second arcuate surface which bears against said hammer head when said accessory body is pivoted towards said inoperative position.

3. An accessory as in claim 1 wherein said coupling means includes an elastomeric band sized and configured to encompass a neck of said hammer head.

4. An accessory as in claim 1 wherein said gripping means includes a pair of resilient gripping fingers which establish a slot therebetween for accepting said nail.

5. An accessory as in claim 4 wherein said slot is defined by opposing serrated interior edges of said pair of gripping fingers.

6. An accessory as in claim 3 wherein a portion of said elastomeric band is retained within said accessory body and positioned substantially transverse relative to said accessory body in such a manner that slippage between said elastomeric band portion and said accessory body is provided.

7. An accessory as in claim 4 wherein said pair of gripping fingers is canted rearwardly so that at least terminal end portions of each said gripping finger are capable of resilient contact with said striking surface.

8. The combination comprising a hammer head and an accessory as in claim 1 coupled to said hammer head.

9. An elastomeric nail holding accessory for a carpenter's hammer to position a nail directly against the hammer head striking face comprising:

an elongated body adapted to contact the bell portion of the hammer head striking face in order to position the nail holder accessory against the hammer head;

a pair of nail grasping members extending perpendicularly from one end of said elongated body for independently contacting said hammer head striking face wherein said pair of nail grasping members define therebetween an open-ended slot so that a nail shank can be manually inserted between said pair of nail grasping members in order for said nail to contact said hammer head striking face;

said elongated body including an end portion at a rear end of said nail holding accessory remote from said pair of nail grasping members for bearing against a neck region of said hammer head in order to counterbalance any tendency of said pair of nail grasping members from prematurely pulling away from said hammer head striking face once said nail holding accessory contacts said hammer head, an arcuated tailpiece extending from said end portion of said elongated body remote from said pair of nail grasping members for providing means to permit curvilinear displacement of said pair of nail grasping members from an initial position against said hammer head striking face once said pair of nail grasping members pull away from said hammer head striking face when said pair of nail grasping members disengage with said nail shank; and an elastomeric band for encompassing said hammer head neck and having a portion thereof molded into and extending outwardly from sides of said elongated body in order to act as a cooperating flexible fastening means for attaching said nail holding accessory to said hammer head.

10. An accessory for a hammer, said hammer having a head and a striking surface, said accessory comprising; an accessory body and means for coupling said accessory body to said hammer, said accessory body having; means for gripping and for automatically releasing a nail subsequent to its being initially driven into a workpiece in responses to rebound of said hammer away from said nail; a bearing surface defined at one end of said accessory body for establishing means permitting pivotal articulation between said accessory body and said hammer head to thereby allow said accessory body to be pivoted between an operative position wherein said gripping means is positioned forwardly of said hammer head striking surface and an inoperative position wherein said gripping means is displaced rewardly of said hammer head striking surface, said bearing surface includes a substantially planar surface which bears against said hammer head when said accessory body is in said operative position, and an arcuate surface which bears against said hammer head when said accessory body is pivoted towards said inoperative position.

11. An accessory as in claim 10 wherein said pivoting to said inoperative position is accomplished during said rebound of said hammer and said means for permitting said pivotal articulation assist in maintaining said accessory body in said inoperative position.

* * * * *